US010631655B2

(12) United States Patent
Bonatz

(10) Patent No.: US 10,631,655 B2
(45) Date of Patent: Apr. 28, 2020

(54) BUNK BED ASSEMBLY

(71) Applicant: Disc-O-Bed Holdings Limited, Limassol (CY)

(72) Inventor: Richard Bonatz, Lanseria (ZA)

(73) Assignee: DISC-O-BED HOLDINGS LIMITED (CY)

( * ) Notice: Subject to any disclaimer, the term of this patent is extended or adjusted under 35 U.S.C. 154(b) by 302 days.

(21) Appl. No.: 14/819,586

(22) Filed: Aug. 6, 2015

(65) Prior Publication Data

US 2017/0035208 A1 Feb. 9, 2017

(51) Int. Cl.

| | |
|---|---|
| ***A47C 19/20*** | (2006.01) |
| ***A47C 17/64*** | (2006.01) |
| ***A47D 7/00*** | (2006.01) |
| ***A47C 19/00*** | (2006.01) |
| ***A47C 19/02*** | (2006.01) |

(52) U.S. Cl.

CPC ..... *A47C 19/202* (2013.01); *A47C 17/64* (2013.01); *A47C 19/005* (2013.01); *A47C 19/028* (2013.01); *A47D 7/005* (2013.01)

(58) Field of Classification Search

CPC ... A47C 19/202; A47C 19/028; A47C 19/005; A47C 17/64; A47D 7/005

See application file for complete search history.

(56) References Cited

U.S. PATENT DOCUMENTS

| | | | | |
|---|---|---|---|---|
| 325,879 | A * | 9/1885 | Vuitton | A45C 9/00 190/2 |
| 3,336,060 | A * | 8/1967 | Bradford | A61G 1/003 403/108 |
| 4,555,821 | A | 12/1985 | Page | |
| 5,150,980 | A * | 9/1992 | Lin | A47C 19/128 403/174 |
| 6,092,769 | A * | 7/2000 | Brown | A61F 2/0095 248/150 |
| 6,345,400 | B2 * | 2/2002 | Elliott | A47C 19/202 5/110 |
| D600,469 | S | 9/2009 | Bonatz | |
| 7,797,772 | B2 | 9/2010 | Bonatz | |
| 7,921,483 | B2 | 4/2011 | Bonatz | |
| 8,356,369 | B2 | 1/2013 | Bonatz | |
| 2004/0035980 | A1 | 2/2004 | McDonnell | |
| 2005/0050633 | A1 | 3/2005 | Roger | |
| 2009/0178195 | A1 * | 7/2009 | Zheng | A47C 17/72 5/111 |
| 2010/0319123 | A1 * | 12/2010 | Bonatz | A47C 17/70 5/114 |
| 2011/0023232 | A1 * | 2/2011 | Sun | A47C 17/72 5/111 |

(Continued)

FOREIGN PATENT DOCUMENTS

| | | |
|---|---|---|
| GB | 446312 | 4/1936 |
| GB | 771450 | 4/1957 |

*Primary Examiner* — Nicholas F Polito
*Assistant Examiner* — Amanda L Bailey
(74) *Attorney, Agent, or Firm* — Lackenbach Siegel, LLP

(57) ABSTRACT

A portable readily assembled and dismantled bunk bed has flexible bed support members with integral flexible head and foot and vertically disposed members that disconnectably engaged and hold the flexible bed support to a horizontal frame member and provide end members that prevent a child from sliding through the frame members.

6 Claims, 6 Drawing Sheets

(56) References Cited

U.S. PATENT DOCUMENTS

2015/0282629 A1* 10/2015 Lamke ..... A47C 19/126
5/111
2016/0198857 A1* 7/2016 Grace ..... A47C 4/286
5/111

* cited by examiner

BUNK BED ASSEMBLY

BACKGROUND OF THE INVENTION

Field of Use of the Invention

This invention relates to a portable bed assembly. This invention specifically relates to components for a bed assembly particularly including a headrest end support. This invention further relates to a portable assembly for a double-decker bed having a headrest end support construction.

Background and Discussion of the Prior Art

Portable bunk bed assemblies are disclosed in U.S. Pat. Nos. 7,797,772, 7,921,483, 8,356,369, and U.S. D600,469 to Bonatz, the inventor herein, which patents are incorporated herein in their entireties by reference thereto.

Bunk beds with rigid fixedly disposed end constructions are disclosed in U.S. Pat. No. 4,555,821 to Page, US Publ. 2004/0035980 to McDonnell and US Publ. 2005/0050633 to Roger.

The immediately aforesaid constructions do not provide or otherwise are not suitable as headrests and protective end supports for children, and are costly to manufacture and assemble.

The art desires a bunk bed headrest and protective end support that is particularly suitable for and safe for use by children, that is readily manufactured, and readily assembled and disassembled.

The present invention provides a solution to these art needs.

SUMMARY OF THE INVENTION

Figure 1:
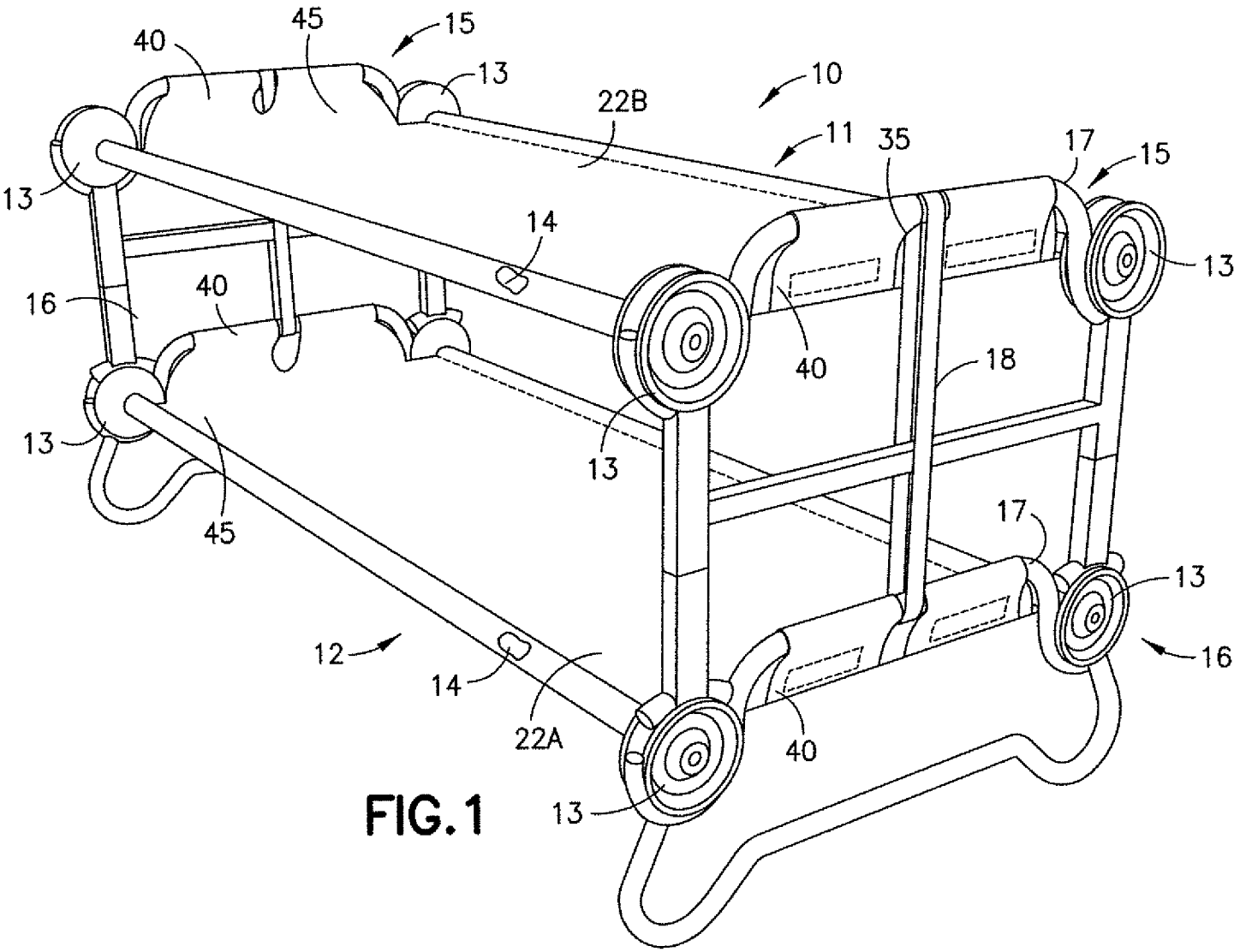
FIG. 1 is a perspective view of the bunk beds showing the present invention.
Figure 2:
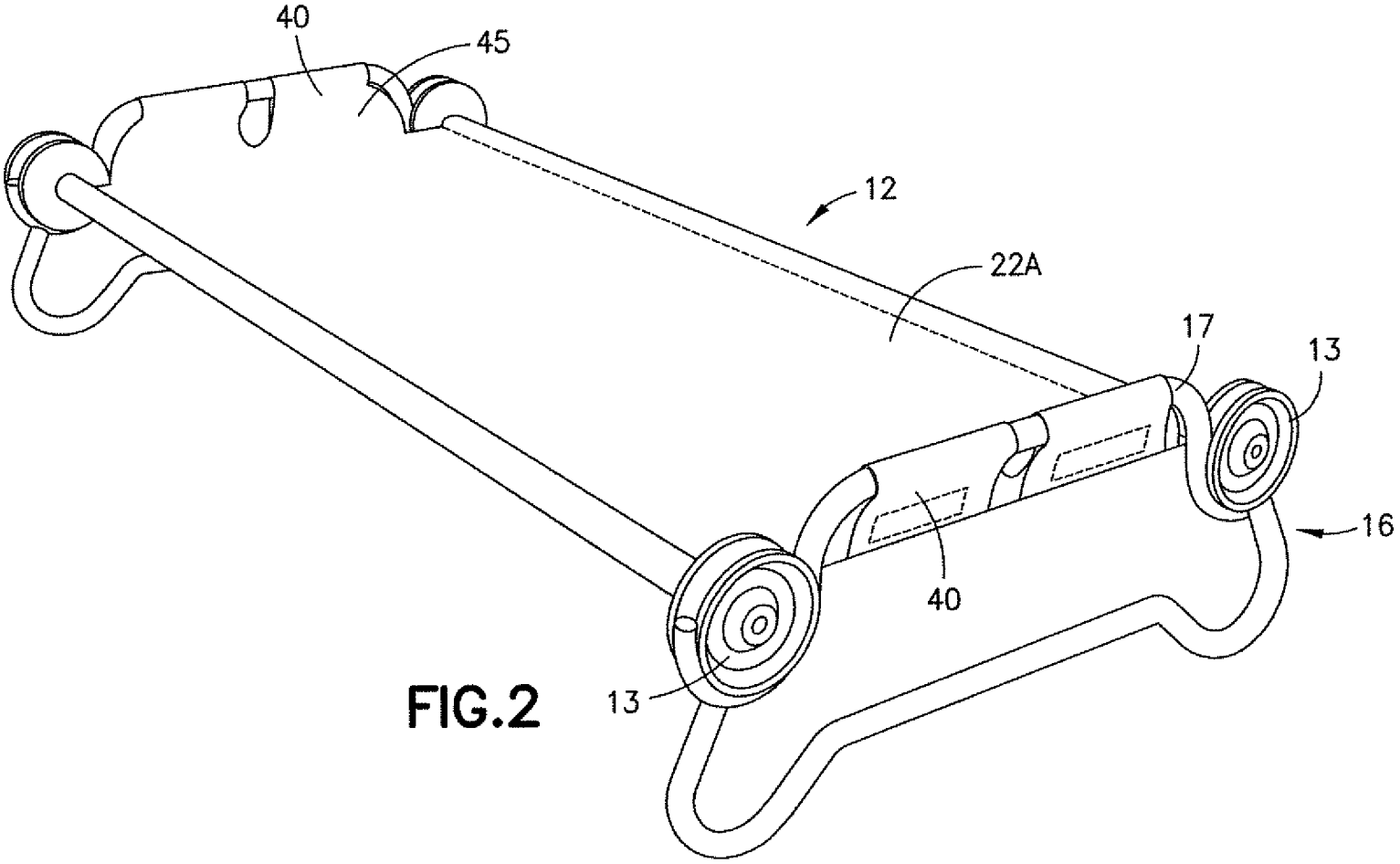
FIG. 2 is a perspective view of the lower bunk bed showing the present invention.
Figure 3:
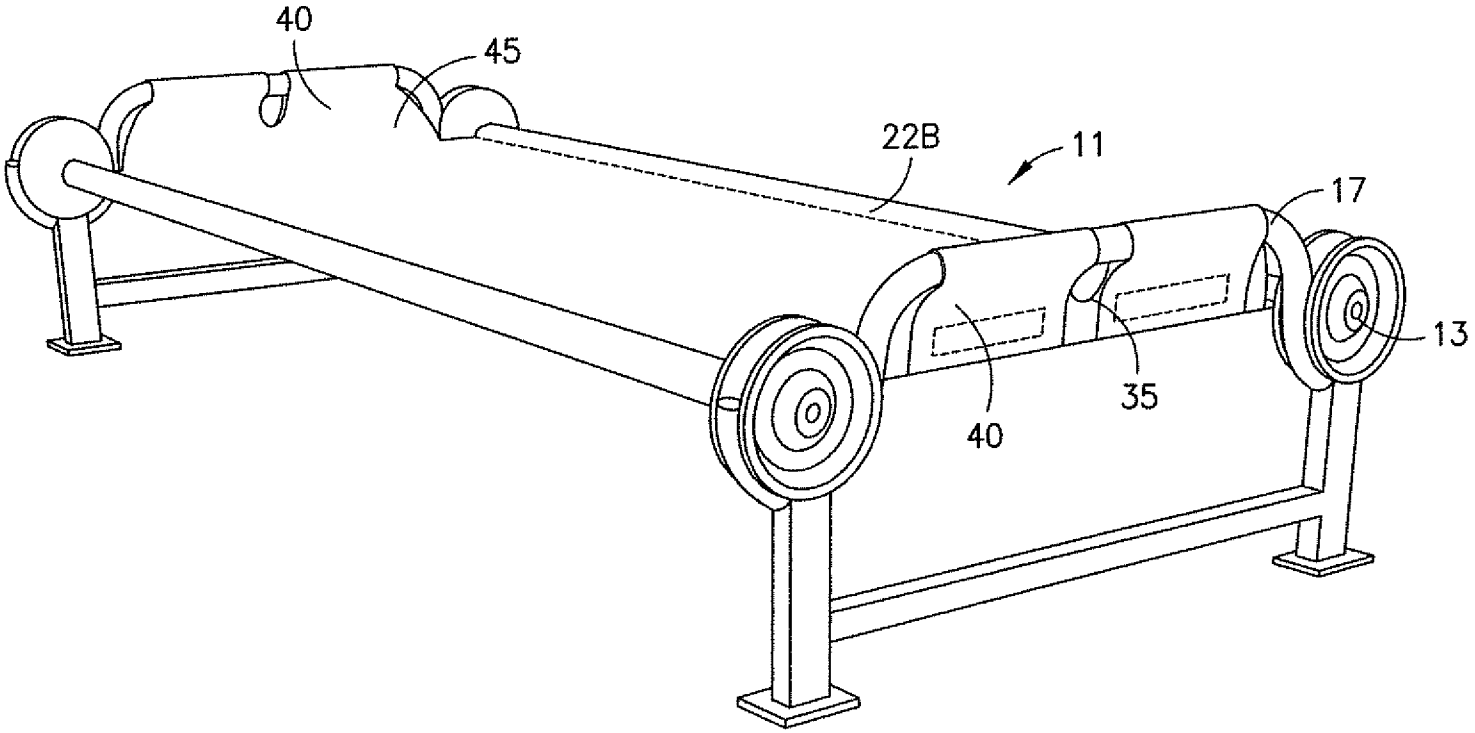
FIG. 3 is a perspective view of the upper bunk bed showing the present invention.
Figure 4:
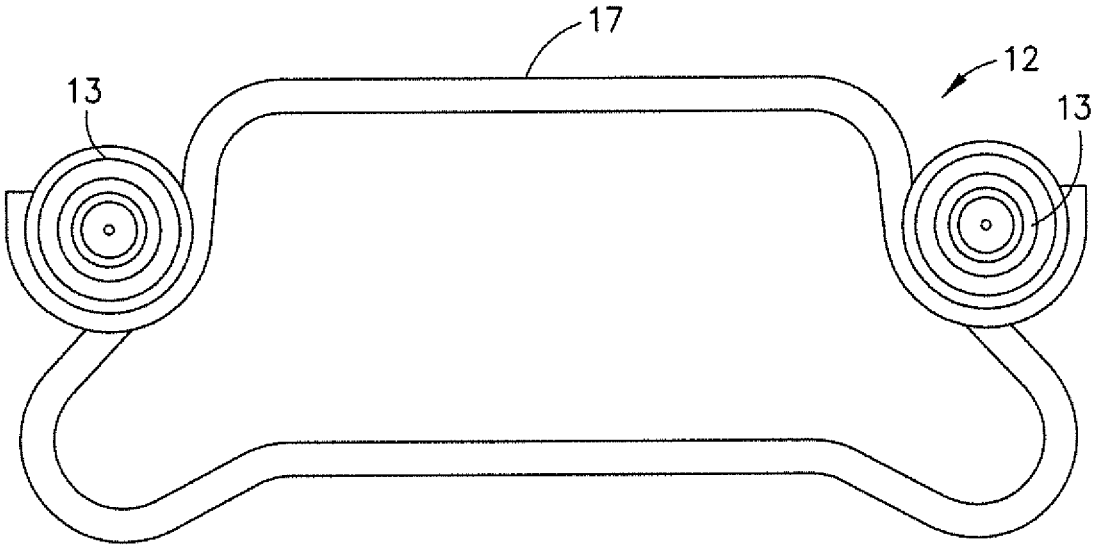
FIG. 4 is an end view of the lower bed frame.
Figure 5:
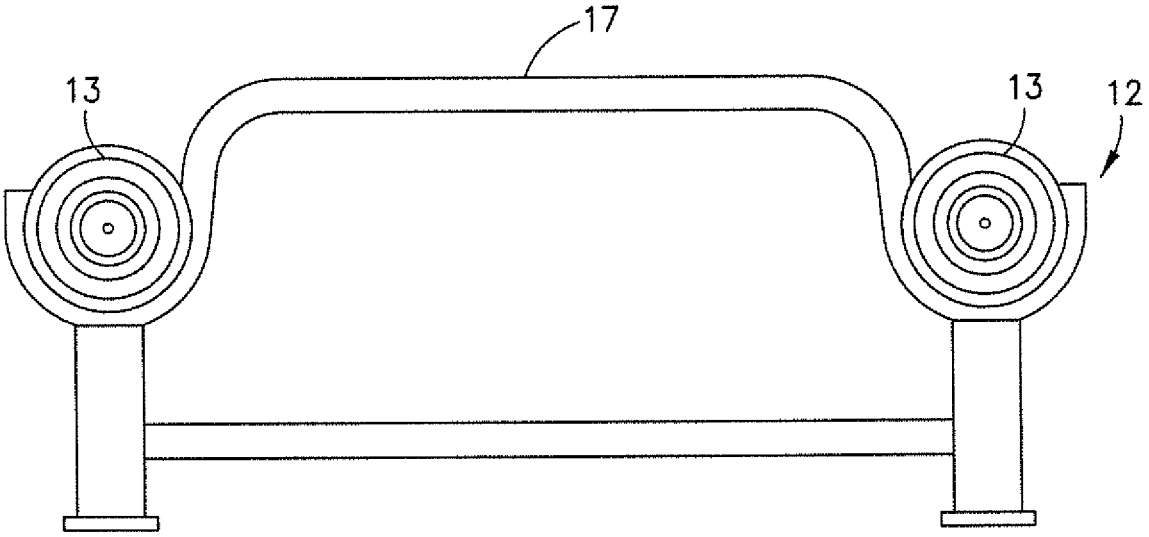
FIG. 5 is an end view of the upper bed frame.
Figure 6:
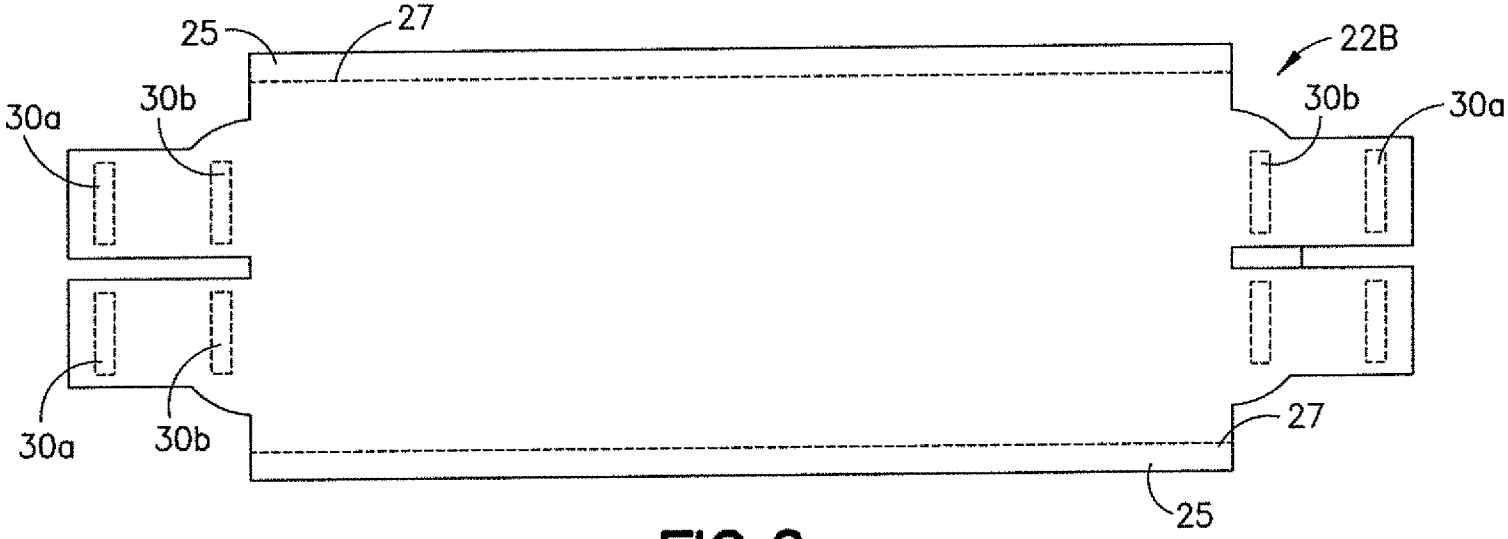
FIG. 6 is a plan view of one side of the mat and headrest of the present invention.
Figure 7:
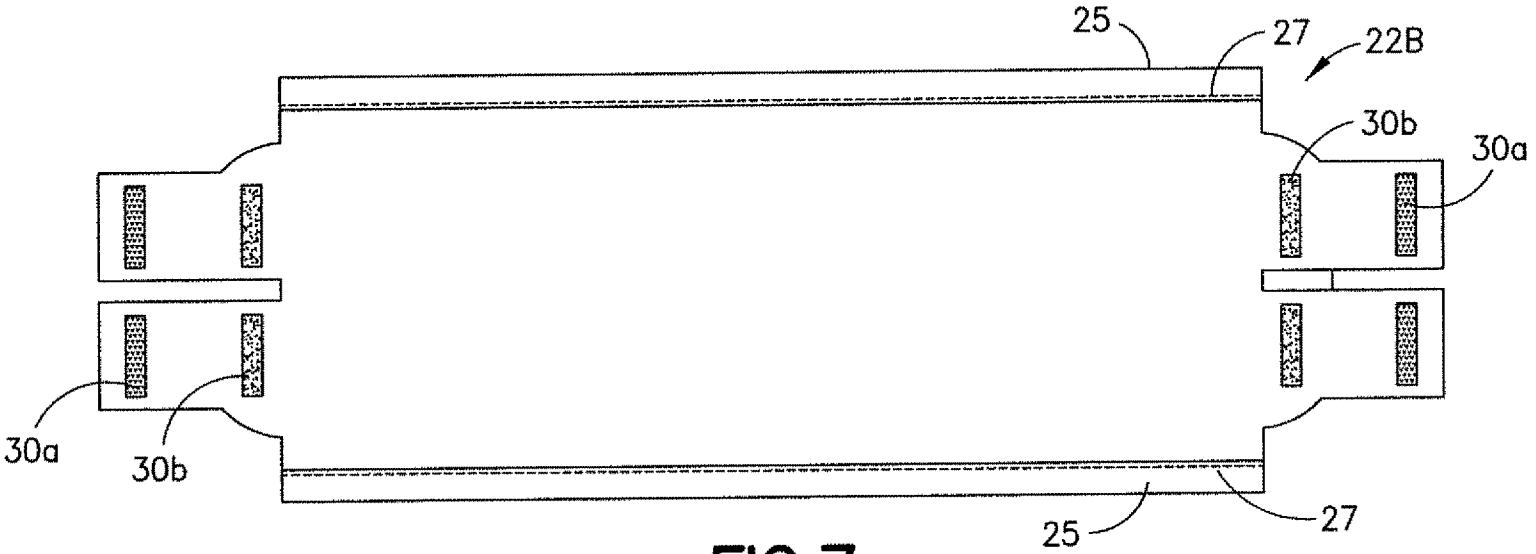
FIG. 7 is a plan view of the other side of the mat and headrest as shown in FIG. 6.

The present invention is a portable bed head end assembly, particularly for a double-decker or bunk beds. The bunk beds have a flexible cot or mat material that integrally includes a readily assembled and disassembled headrest or protective end piece. The flexible mat headrest construction protects and encloses a child when sleeping on the upper or lower bed.

DESCRIPTION OF THE INVENTION

The bunk bed assembly, particularly the disc and metal elongate support and frame assembly members, as shown in the FIGS., may be those as shown and described in U.S. Pat. No. 7,921,483, issued Apr. 12, 2011 and U.S. Pat. No. 8,356,369, issued Jan. 22, 2013 to Bonatz, the herein inventor, which references are incorporated herein in their entireties by reference thereto.

Referring to the FIGS., there is shown the double-decker bed or bed assembly 10 of the present invention. Bed 10 includes an upper bed or cot 11 and a lower bed or cot 12. The bed construction in general includes eight assembly discs 13, four tubular assembly side members construction in general includes eight assembly discs 13, four tubular assembly side members or assemblies 14 (typical), two upper bed tubular head or foot assemblies 15, and two lower head or foot assemblies 16, two horizontally disposed cross members or supports 17, two vertically disposed integrating connecting straps 18, and two canvas or like flexible material bed support pieces 22A and 22B.

Referring to the FIGS., there is shown the lower bed or cot 12 in the single bed disposition. Bed 12 has four assembly discs 13 and two tubular foot assemblies 16 and two tubular frame assemblies 14 interconnected with flexible material or canvas bed support piece 22A to in general from the assembled single lower bed 12.

Referring to the FIGS., there is shown upper bed or cot 11 in the single bed disposition. Bed 11 has four assembly discs 13, two tubular assemblies 15, two tubular frame assemblies 14 with flexible material or canvas bed support piece 22B to in general form the assembled single upper bed 11.

In the afore-discussed construction, two essentially uniform construction carrying cases may be provided to effectively stow all the components for assembling the double-decker bed or two separate single beds. Canvas bed supports 22A and B may also be like or separately transported or provided. The canvas bed supports may need to be periodically washed or replaced with extended use.

Figure 8:
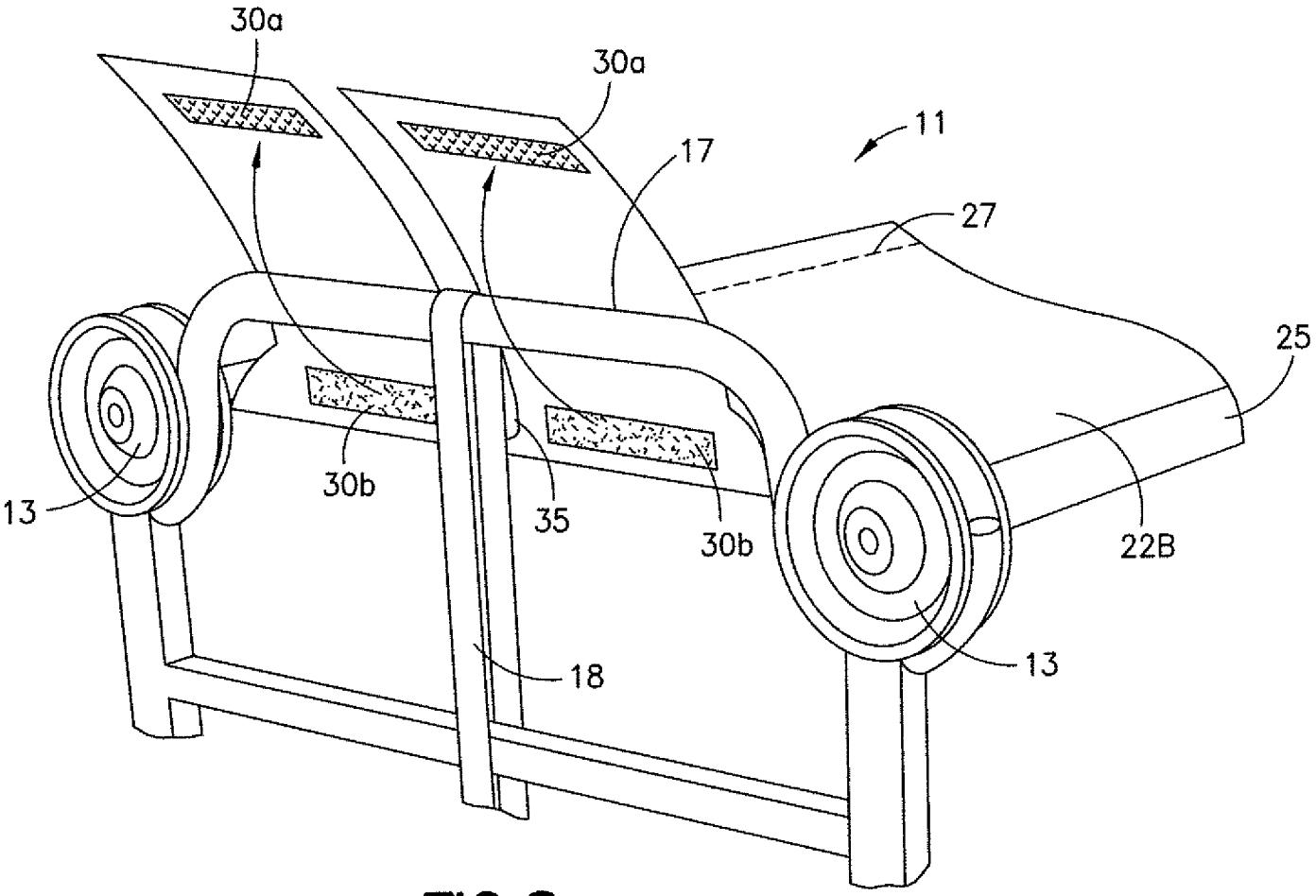
FIG. 8 is a perspective view showing the assembly of the headrest as shown in FIGS. 6-7, on the upper bunk end frame as show in FIG. 5.

Referring to FIGS. 1, 2, 3 and 6-8, there is shown canvas bed support members 22A and 228. Bed support members 22A and 23B may be a one-piece construction with side portions 25 (typical) enclosed by stitching 27 (typical) for slidably receiving metal tubular supports 14 (typical). The head or foot ends of each bed support member is formed with two spaced flaps 26 (typical). Each flap has cooperatively engaging Velcro® elements 30*a* and 30*b*, for purposes hereinafter appearing. The spaced flaps 26 form a slot 31 (typical) for slidably accommodating vertical straps 18 (FIGS. 1 and 8). The slot end portions may be contoured at 35, as best shown in FIGS. 1 and 8. Referring to the FIGS., there is shown Velcro® elements 30*a* and 30*b* disconnectably connected so as to be connected around horizontal frame member 17. In the aforesaid manner of construction vertically disposed end portions 40 (typical) are provided at the head and foot ends of the upper and lower beds. The end portions 40 prevent a child from sliding through the frame and falling off the bed. The Velcro® elements 30*a* and 30*b* are disposed on the outside of the bed and may not be readily tampered with or disengaged by a child sleeping in the upper or lower bed. Vertically disposed end support 40 is curved or contoured as at 45 for headrest comfort.

In the afore-described construction, a double-decker bed or two separate single beds can be readily assembled and disassembled. While the foregoing describes a construction assembly for one double-decker bed or two single beds, it is within the contemplation of the present invention to provide further expanded construction assemblies such as for a triple-decker bed.

The foregoing description is intended to be merely illustrative and not limiting of the invention, which invention is defined by the adjoined claims.

What is claimed is:

1. A portable bunk bed assembly comprising:

a first bed and a second bed, each bed comprises a frame construction having side frames and of a transversely disposed head frame and foot frame, said respective head or foot frame being spacedly upwardly disposed from said side frames, and each bed further comprises a flexible support comprising a top side and a bottom side, said flexible support further comprises end portions, at least one said end portion comprises first and second spacedly disposed connecting elements fixedly disposed on the bottom side of the flexible support, whereby the flexible support end portion is disposed over the respective head or foot frame and the connecting elements being disconnectably connected, wherein the flexible support is mounted to the frame construction and comprises an upwardly angularly disposed contoured protective headpiece or protective foot piece; and said portable bunk bed assembly further comprises a vertically disposed strap contactingly engaging the first bunk bed head frame and second bunk bed head frame immediately adjacent the respective end portions, and a vertically disposed strap contactingly engaging the first bunk bed foot frame and second bunk bed foot frame immediately adjacent the respective end portions; whereby the upwardly disposed headpieces and foot pieces are secured, each end portion comprises two spacedly disposed flaps, and each vertically disposed strap being disposed between the respective spacedly disposed flaps, to prevent an occupant from sliding out the head or foot end of the assembled bunk bed.

2. The portable bed assembly of claim 1, wherein each end portion comprises a flexible fabric.

3. The portable bed assembly of claim 2, wherein the end portion flexible fabric and the flexible bed support are a one-piece construction.

4. The portable bed assembly of claim 3, wherein the end portion fabric and the bed support consist of the same material.

5. An assembled double-decker portable bed comprising; a plurality of discs and elongate bed frame members interfitted with the discs to form an upper bed and a lower bed, each said disc comprises a cylindrical body comprising a central hole having an axis and further comprising a peripheral concave surface for removably receiving the frame members in respective portions of the discs, each said disc comprises a plurality of ribs extending outwardly between the central hole and the peripheral surface; and each said upper and lower bed comprises;

said frame members further comprising side frames and at least one of a transversely disposed head frame and foot frame, said head and foot frame being spacedly upwardly disposed from said side frames, a flexible support comprising a top side and a bottom side, and said flexible support further comprises two end portions, said end portions comprise first and second spacedly disposed connecting elements disposed on the bottom side of the flexible support, whereby each flexible support end portion is disposed and contactingly engages the respective head or foot frame and the connecting elements are disconnectably connected and the flexible support is mounted to the head or foot frame and therein comprises an upwardly angularly disposed protective headpiece or protective foot piece; and said assembled double-decker bed further comprises a vertically disposed strap contactingly engaging the upper bed head frame and the lower bed head frame, wherein each flexible support comprises edge portions adjacent the upper frame and the lower frame and the vertically disposed strap is disposed adjacent the flexible support edge portions; whereby the upwardly angularly disposed headpieces and foot pieces are secured so that an occupant does not slide out the foot or head end of the bed, and wherein each end portion comprises two spacedly disposed end portions, and wherein the contactingly engaged strap is disposed between the two spacedly disposed end portions.

6. A portable bunk bed assembly comprising:

a first bed and a second bed, each bed comprises a frame construction having side frames and of a transversely disposed head frame and foot frame, said respective head or foot frame being spacedly upwardly disposed from said side frames, and each bed further comprises a flexible support comprising a top side and a bottom side, said flexible support further comprises end portions, at least one said end portion comprises first and second spacedly disposed connecting elements fixedly disposed on the bottom side of the flexible support, whereby the flexible support end portion is disposed over the respective head or foot frame and the connecting elements being disconnectably connected, wherein the flexible support is mounted to the frame construction and comprises an upwardly angularly disposed contoured protective headpiece or protective foot piece; and said portable bunk bed assembly further comprises a vertically disposed strap contactingly engaging the first bunk bed head frame and second bunk bed head frame immediately adjacent the respective end portions, and a vertically disposed strap contactingly engaging the first bunk bed foot frame and second bunk bed foot frame immediately adjacent the respective end portions; whereby the upwardly disposed headpieces and foot pieces are secured, each end portion comprises two spacedly disposed flaps, and each vertically disposed strap being disposed between the respective spacedly disposed flaps, to prevent an occupant from sliding out the head or foot end of the assembled bunk bed, and wherein each said vertically disposed strap is facingly disposed to a respective upwardly angularly disposed headpiece or foot piece.

* * * * *